US006126055A

United States Patent [19]

Gantner et al.

[11] Patent Number: 6,126,055

[45] Date of Patent: Oct. 3, 2000

[54] EXPLOSIVE POWDER CHARGE OPERATED SETTING TOOL

[75] Inventors: Gebhard Gantner, Nenzing; Markus Sprenger, Eschen, both of Germany

[73] Assignee: Hilti Aktiengesellschaft, Schaan, Liechtenstein

[21] Appl. No.: 09/495,808

[22] Filed: Feb. 1, 2000

[30] Foreign Application Priority Data

Feb. 2, 1999 [DE] Germany ..... 199 03 993

[51] Int. Cl.[7] ..... B25C 1/14

[52] U.S. Cl. ..... 227/10; 227/9

[58] Field of Search ..... 227/9, 10, 11

[56] References Cited

U.S. PATENT DOCUMENTS

| | | | |
|---|---|---|---|
| 4,598,851 | 7/1986 | Kopf | 227/9 |
| 4,655,380 | 4/1987 | Haytayan | 227/10 |
| 5,029,744 | 7/1991 | Pai | 227/10 |
| 5,170,922 | 12/1992 | Ehmig et al. | 227/10 |
| 5,715,983 | 2/1998 | Lee | 227/9 |
| 5,884,828 | 3/1999 | Hirtl et al. | 227/10 |

*Primary Examiner*—Scott A. Smith

*Attorney, Agent, or Firm*—Brown & Wood, LLP

[57] ABSTRACT

An explosive powder charge-operated setting tool including a guide cylinder (2) displaceable relative to the tool housing (1), a drive piston (4) displaceably arranged in the inner bore (25) of the guide cylinder (2), a control pin (8) projecting from the guide cylinder (2) in a direction opposite to a setting direction, a spring-biased firing pin (16) cooperating with the control pin (8), a release pusher (19) for displacing the mating surface (26) of the firing pin (16) out of an axial projection surface of the control pin (8), a trigger (15) for actuating the release pusher (19), and a back-up pin (9) projecting into the inner bore (25) of the guide cylinder (2), with a smallest distance (A3) between the back-up pin (9) and a bottom (28) of the inner bore (25) facing in the setting direction corresponding to a length of the drive piston (4) between its end surface facing in the direction opposite to the setting direction and its stop surface (29) facing in the setting direction and cooperating with the back-up pin (9), and with a smallest distance (A1) between the back-up pin (9) and a free end surface of the control pin (8) plus a clearance (5) between the mating surface (26) of the firing pin (16) and the free end surface of the control pin (8) corresponding to a smallest distance (A2) between the back-up pin (9) and the mating surface (26) of the firing pin (16).

5 Claims, 4 Drawing Sheets

EXPLOSIVE POWDER CHARGE OPERATED SETTING TOOL

BACKGROUND OF THE INVENTION

1. Field of the Invention

The present invention relates to an explosive powder charge-operated setting tool including a housing, a guide cylinder displaceable relative to the housing and having an inner bore, a drive piston displaceably arranged in the inner bore of the guide cylinder, a control pin projecting from the guide cylinder in a direction opposite to the setting direction, a firing pin cooperating with the control pin, a spring for biasing the firing pin in the setting direction, a release pusher formlockingly connectable with the firing pin for displacing the mating surface of the firing pin out of an axial projection surface of the control pin, and a trigger for actuating the release pusher.

2. Description of the Prior Art

For driving nail-shaped fastening elements in a hard constructional component formed of stone, steel, concrete, and the like, explosive powder charge-operated setting tools are used. Such setting tool is produced, e.g., by a company Hilti AG, Liechtenstein, an assignee of the present application. The known setting tool has a housing, a guide cylinder displaceable relative to the housing, and a drive piston displaceably arranged in the inner bore of the guide cylinder. A control pin projects from an end of the guide cylinder facing in a direction opposite to the setting direction. The control pin is displaced, together with the guide cylinder, in the direction opposite to the setting direction when the setting tool is pressed against a constructional component. The control pin cooperates with a mating surface of a firing pin for displacing the firing pin in its firing position. Upon being displaced in its firing position, the firing pin preloads a spring which cooperates with the firing pin and biases the firing pin in the setting direction.

In the firing position of the firing pin, a portion of the firing pin projects into a recess formed in a release pusher which, upon actuation of the trigger, is displaced substantially transverse to the setting direction. Upon the displacement of the release pusher in response to the actuation of trigger, the firing pin rotates about its longitudinal axis, and the mating surface of the firing pin is displaced out of axial projection surface of the control pin. Upon release of the spring preloaded by the firing pin, the spring accelerates the firing pin in the setting discretion until it impacts a firing region of a cartridge and ignites the same. The firing pin is biased sidewise toward the control pin by a return spring. Only upon lifting of the setting tool off the constructional component, the guide cylinder is biased by a corresponding spring into its initial position. The control pin is also displaced in the setting direction, together with the guide cylinder. Already after the displacement of the guide cylinder, in the setting direction, by a distance that corresponds to a length of the axial displacement of the firing pin, the control pin releases the firing pin during the lifting of the setting tool off. As a result, the mating surface of the firing pin can be pivoted by the return spring back into the axial projection of the control pin.

Accordingly, an object of the present invention is to provide an explosive powder charge-operated setting tool in which the release of the firing pin and, thereby, its subsequent displacement into the firing position is prevented upon the contamination of the combustion chamber, which is formed between the bottom of the inner bore of the guide cylinder and the end surface of the drive piston facing in the direction opposite to the setting direction, rising above a predetermined amount.

Another object of the present invention is an explosive powder charge-operated setting tool that can indicate to the operator that a combustion chamber, formed between the inner bore of the guide cylinder and an end surface of the drive piston facing in the direction opposite to the setting direction, has been contaminated above a predetermined amount and that the setting tool requires cleaning.

SUMMARY OF THE INVENTION

These and other objects of the present invention, which will become apparent hereinafter, are achieved by providing, in the setting tool of the type described above, a back-up pin projecting into the inner bore of the guide cylinder, with a smallest distance between the back-up pin and a bottom of the inner bore facing in the setting direction corresponding to a length of the drive piston between end surface of the drive piston facing in the direction opposite to the setting direction and its stop surface facing in the setting direction and cooperating with the back-up pin, and with a smallest distance between the back-up pin and a free end surface of the control pin plus a clearance between the mating surface of the firing pin and the free end surface of the control pin corresponding to a smallest distance between the back-up pin and the mating surface of the firing pin.

Providing of the back-up pin and its location, with respect to the bottom of the guide cylinder bore, the end surface of the control pin facing in a direction opposite to the setting direction, and the mating surface of the firing pin, permits to prevent displacement of the mating surface of the firing pin into the axial projection surface of the control pin when a residue, which is caused by an incomplete combustion of the powder charge, is formed on the bottom of the inner bore of the guide cylinder. This residue prevents a complete displacement of the guide cylinder relative to the housing in the setting direction and, thereby, prevents release of the firing pin by the control pin.

In order to prevent a significant accumulation of the non-burned powder in the setting tool, the clearance between the mating surface of the firing pin and the free end surface of the control pin should not exceed 2 mm. Experiments have shown that for an optimal utilization of the energy generated by the cartridge, this clearance should preferably be within a range from 0.1 mm to 1 mm.

In order to be able to control the degree of the contamination, the clearance can be made adjustable.

For manufacturing reasons, the smallest distance between the back-up pin and the free end surface of the control pin is also preferably made adjustable. The adjustment can be effected, e.g., by providing a threaded connection between the control pin and the guide cylinder. Thus, when the control pin is screwed but from the guide cylinder, the firing pin could not be displaced into its firing position even at a smaller contamination and vise versa. Another advantage of the threaded connection between the control pin and the guide cylinder consists in that the clearance cannot be adjusted from outside. The adjustment or correction of the clearance can be effected only upon servicing of the setting tool, i.e., during its assembly or cleaning.

The novel features of the present invention, which are considered as characteristic for the invention, are set forth in particular in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
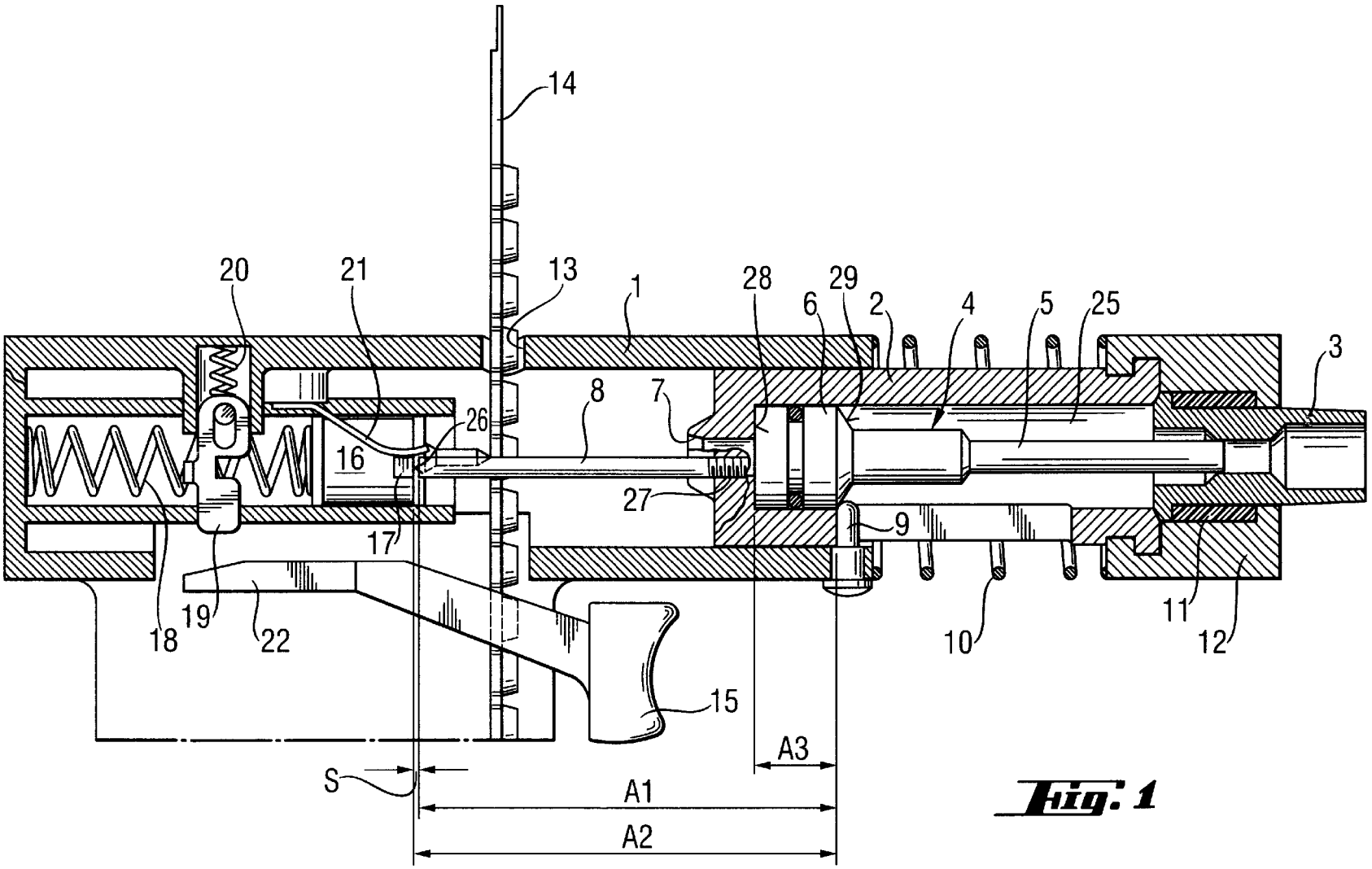
FIG. 1 a cross-sectional view of a guide cylinder with a drive piston and a firing pin of an explosive powder charge-operated setting tool according to the present invention in the initial position of the setting tool.

An explosive powder charge-operated setting tool according to the present invention, which is shown in FIGS. 1–4, includes a housing 1, a guide cylinder 2 with an inner bore 25, a drive piston 4 displaceable in the inner bore 25 of the guide cylinder 2, a control pin 8, a firing pin 16, a release pusher 19, and a trigger 15.

The guide cylinder 2 projects into the housing 1 and is displaced relative to the housing 1 in a direction opposite the setting direction against a biasing force of a spring 10. The guide cylinder 2 has, at its rear, in the setting direction end a bottom 28 into which opens into a connection channel that extends up to a cartridge chamber 7 of the guide cylinder 2. At its front, in the setting direction, end, the guide cylinder 2 is adjoined by a guide tube 3. The guide tube 3 is supported in a stopper 12 by a damping member 11. The guide tube 3 projects beyond the stopper 12 in the setting direction and has a central bore open in the setting direction. The central bore of the guide tube 3 has a region for receiving a nail-shaped fastening element 24. The stopper 12 projects beyond the guide cylinder 2 in a radial direction. The spring 10, which biases the guide cylinder 2 in the setting direction, surrounds the guide cylinder 2 and is supported at its opposite ends against a circular shoulder of the housing 1 facing in the setting direction and a circular shoulder of the stopper 12 facing in a direction opposite to the setting direction.

The drive piston 4 has a head 6, the diameter of which substantially corresponds to the diameter of the inner bore 25 of the guide cylinder 2, and an extending in the setting direction stem 5, which adjoins the head 6 and the diameter of which is smaller than the diameter of the head 6. The central bore of the guide tube 3 has a section for guiding the stem 5 of the drive piston 4 and the diameter of which substantially corresponds to the diameter of the stem 5.

In the end region of the housing 1 facing in the setting direction, there is provided a back-up pin 9 that extends through a longitudinal slot formed in the guide cylinder 2, projects into the inner bore 25 of the guide cylinder 2, and is operationally connectable with the drive piston 4. The control pin 8 projects from the guide cylinder 2 in a direction opposite to the setting direction. The control pin 8 is displaceable, together with the guide cylinder 2, relative to the housing 1. The control pin 8 is adjustably connected with the guide cylinder 2 by a thread connection 27. The smallest distance A1 between the back-up pin 9 and the free end of the control pin 8 plus a clearance S corresponds to the smallest distance A2 between the back-up pin 9 and the mating surface 26 of the firing pin 16.

Figure 2:
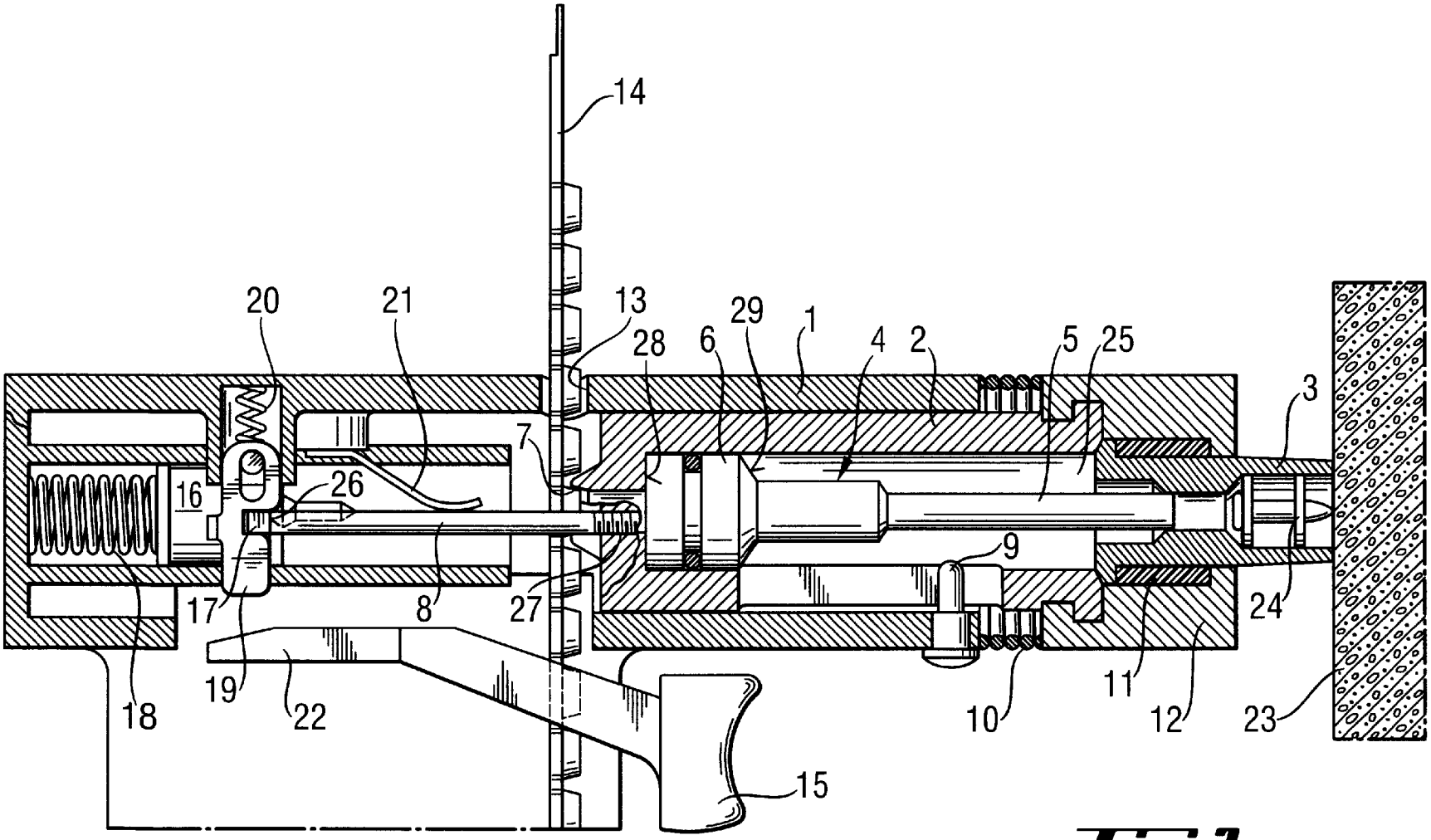
FIG. 2 a cross-sectional view of the guide cylinder shown in FIG. 1 in a position of the setting tool in which it is pressed against a constructional component.

The control pin 8 displaces, upon pressing the setting tool against a constructional component 23, as shown in FIG. 2, the firing pin 16 relative to the housing and against a biasing force of a spring 18, in the direction opposite to the setting direction, from an initial position of the firing pin 16 into the firing position of the firing pin 16. The spring 18 becomes preloaded, and a catch 17 of the firing pin 16 becomes engaged in a recess of the release pusher 19.

Figure 3:
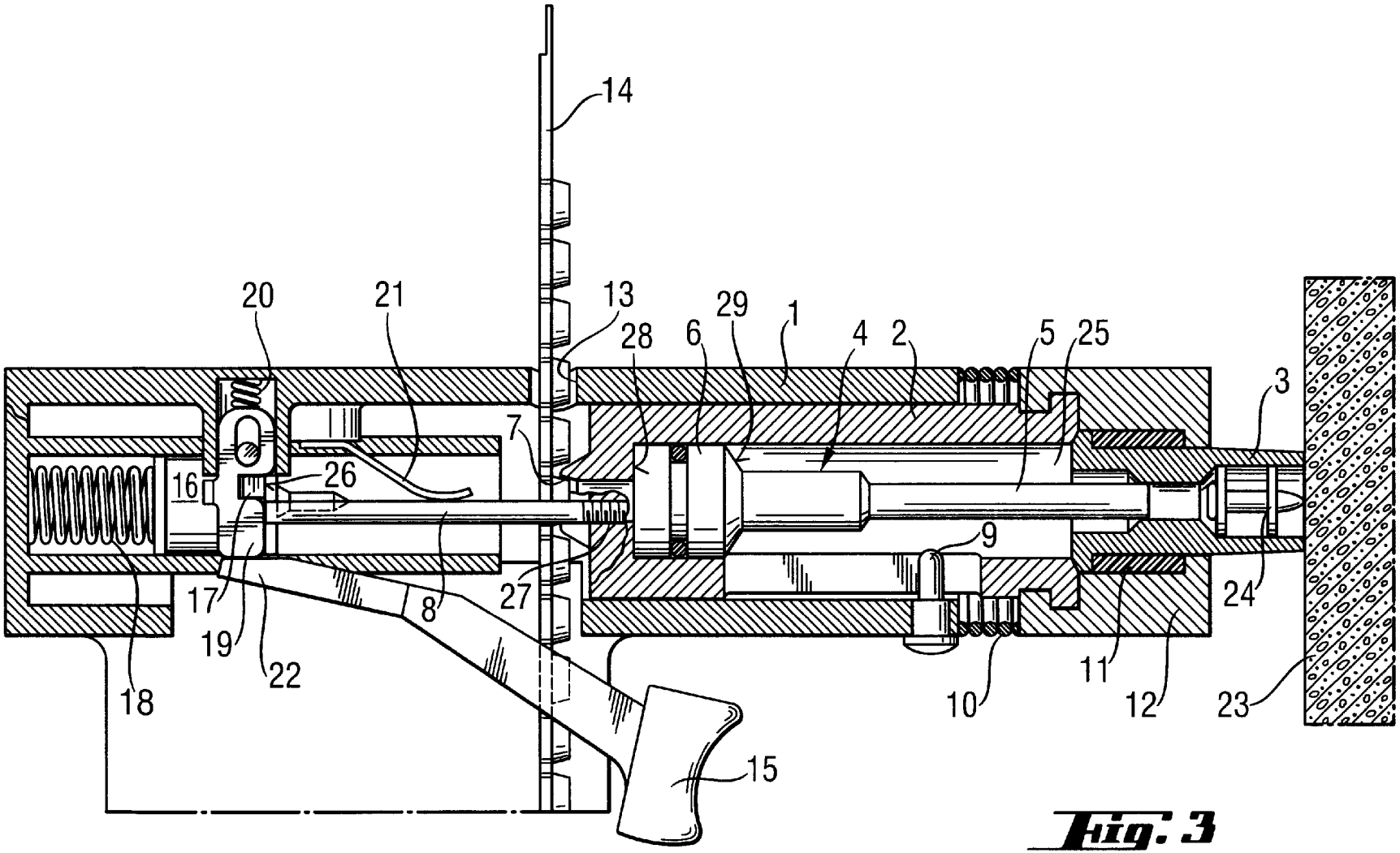
FIG. 3 a cross-sectional view of the guide cylinder shown in FIG. 1 in the pressed-against position of the setting tool and with the trigger being depressed.

The release of the firing pin 16, as shown in FIG. 3, is effected upon the depression of the trigger 15 the release lever 22 of which is displaced in a direction transverse to the setting direction. The displacement of the lever 22 of the trigger 15, upon actuation of the trigger 15, preloads a spring 20 that cooperates with the release pusher 19. The catch 17, which is formlockingly engaged in the recess of the release pusher 19, upon compression of the spring 20, is displaced from the recess of the release pusher 19, whereby the spring 18 accelerates the firing pin 16 in the setting direction until the firing pin 16 impacts a cartridge and ignites it. Upon displacement of the firing pin 16 in the setting direction by the spring 18, the catch 17 preloads a return spring 21 that is located sidewise of the catch 17 and is pressed against the control pin 8. Only after the setting tool is lifted off the constructional component 23, the control pin 8, together with the guide cylinder 2, is displaced in the setting direction until the guide cylinder 2 again occupies its initial position. In the initial position of the guide cylinder 2, a stop surface 29 of the drive piston 4 facing in the setting direction engages the back-up pin 9, and an end surface of the drive piston 4 facing in the direction opposite to the setting direction abuts the bottom 28 of the inner bore 25 of the guide cylinder 2. The smallest distance between the back-up pin 9 and the bottom 28 is designated with a reference character A3. In the initial position of the guide cylinder 2, the control pin 8 releases the catch 17 of the firing pin 16, so that the mating surface 26, which is provided on the catch 17, can be displaced by the return spring 21 toward an axial projection surface of the control pin 8. A clearance between the mating surface 26 of the firing pin 16 and the free end of the control pin 8 amounts to less than 2 mm.

The displacement of the catch 17 from and toward the axial projection surface of the control pin 8 is effected, e.g., by rotating the firing pin 16 about its longitudinal axis.

Figure 4:
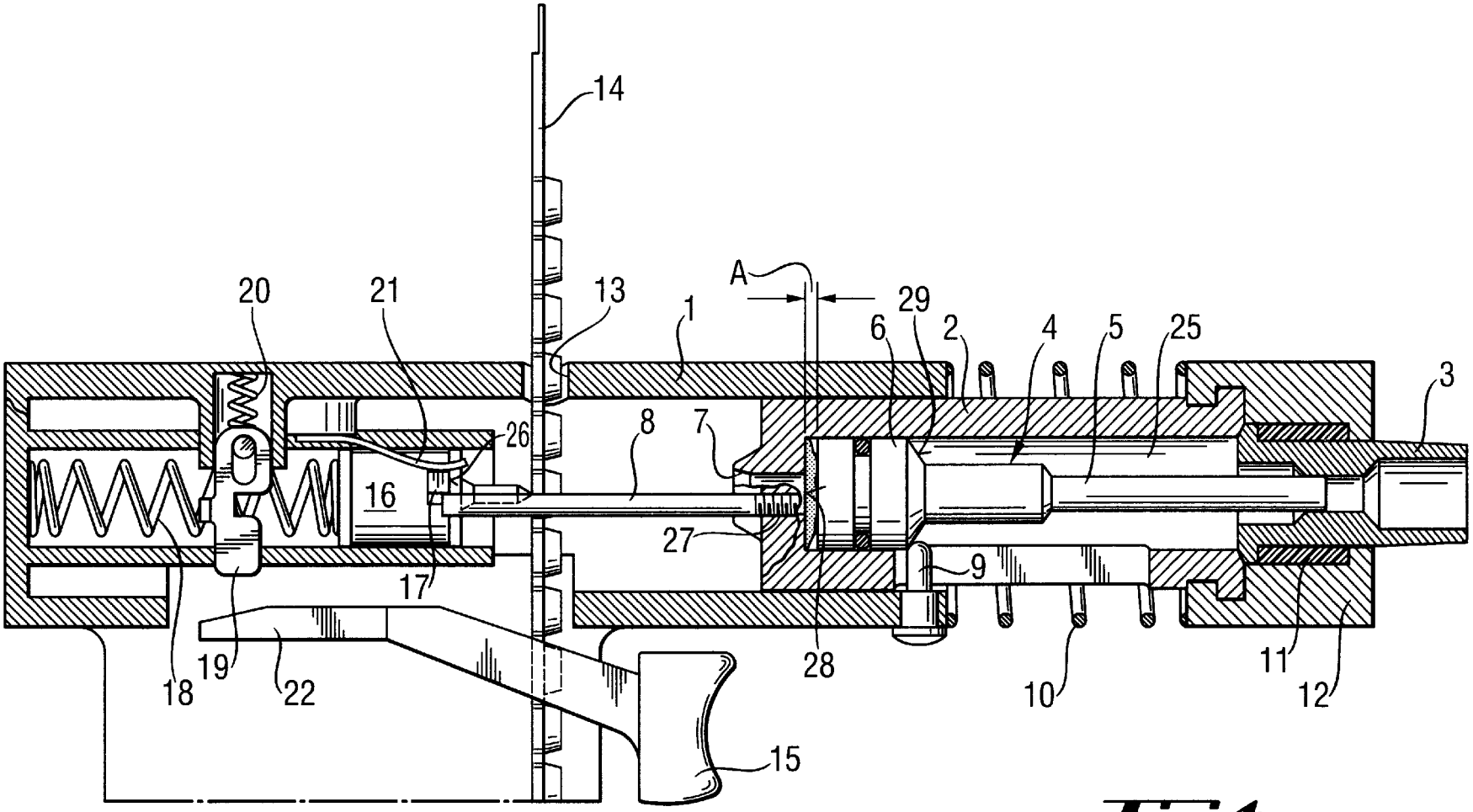
FIG. 4 a cross-sectional view of the guide cylinder shown in FIG. 1 with a contaminated combustion chamber.

In FIG. 4, the reference character A indicates contamination of the inner bore 25 of the guide cylinder 2. The contamination can be caused, e.g., by a non-burned powder residue. Upon displacement of the guide cylinder 2 in the setting direction, it may not reach its initial position because of this contamination. As a result, the control pin 8, which is displaceable together with the guide cylinder 2, may not completely release the catch 17 of the firing pin 17, so that upon a subsequent setting process, no displacement of the firing pin 16 into its firing position by the control pin 8 takes place.

A catridge magazine 14 is located in a catridge channel 13 provided between the catridge chamber 7 of the guide cylinder 2 and the firing pin 16 and extending in the direction transverse to the setting direction.

Though the present invention was shown and described with references to the preferred embodiment, such is merely illustrative of the present invention and is not to be construed as a limitation thereof and various modifications of the present invention will be apparent to those skilled in the art.

It is therefore not intended that the present invention be limited to the disclosed embodiment or details thereof, and the present invention includes all variations and/or alternative embodiments within the spirit and scope of the present invention as defined by the appended claims.

What is claimed is:

1. An explosive powder charge-operated setting tool, comprising a housing (1); a guide cylinder (2) displaceable relative to the housing (1) and having an inner bore (25); a drive piston (4) displaceably arranged in the inner bore (25) of the guide cylinder (2); a control pin (8) projecting from the guide cylinder (2) in a direction opposite to a setting direction; a firing pin (16) cooperating with the control pin (8) and having a mating surface (26); a spring (18) for biasing the firing pin (16) in the setting direction; a release pusher (19) form-lockingly connectable with the firing pin (16) for displacing the mating surface (26) of the firing pin (16) out of an axial projection surface of the control pin (8); a trigger (15) for activating the release pusher (19); and a backup pin (9) projecting into the inner bore (25) of the guide cylinder (2), with a smallest distance (A3) between the back-up pin (9) and a bottom (28) of the inner bore (25) facing in the setting direction corresponding to a length of the drive piston (4) between an end surface thereof facing in the direction opposite to the setting direction and a stop surface (29) thereof facing in the setting direction and cooperating with the back-up pin (9), and with a smallest distance (A1) between the back-up pin (9) and a free end surface of the control pin (8) plus a clearance (5) between the mating surface (26) of the firing pin (16) and a free end surface of the control pin (8) corresponding to a smallest distance (A2) between the back-up pin (9) and the mating surface (26) of the firing pin (16).

2. An explosive powder charge-operated setting tool according to claim 1, wherein the clearance between the mating surface (26) of the firing pin (16) and the free end surface of the control pin (8) is less than 2 mm.

3. An explosive powder charge-operated setting tool according to claim 2, wherein the clearance between the mating surface (26) and the end surface of the control pin (8) amounts to from 0.1 mm to 1 mm.

4. An explosive powder charge-operated setting tool according to claim 1, wherein the clearance between the mating surface (26) of the firing pin (16) and the end surface of the control pin (8) is adjustable.

5. An explosive powder charge-operated setting tool according to claim 1, further comprising means for adjusting the distance between the back-up pin (9) and the free end surface of the control pin (8).

* * * * *

UNITED STATES PATENT AND TRADEMARK OFFICE

CERTIFICATE OF CORRECTION

PATENT NO. 6,126,055

DATED October 3, 2000

INVENTOR(S) Gebhard Gantner, et al

It is certified that error appears in the above-identified patent and that said Letters Patent is hereby corrected as shown below:

Title page, item,

{75} Inventors:

Gebhard Gantner, Nenzing, Austria; Markus Sprenger, Eschen, Liechtenstein

Signed and Sealed this

First Day of May, 2001

*Attest:*

Nicholas P. Godici

NICHOLAS P. GODICI

*Attesting Officer*

*Acting Director of the United States Patent and Trademark Office*